United States Patent [19]

Britt

[11] 4,146,995

[45] Apr. 3, 1979

[54] ADJUSTABLE THRESHOLDS AND METHODS OF MAKING AND USING THE SAME

[76] Inventor: Robert E. Britt, 11 Cumberland, Maryland Heights, Mo. 63042

[21] Appl. No.: 737,695

[22] Filed: Nov. 1, 1976

Related U.S. Application Data

[63] Continuation-in-part of Ser. No. 582,979, Jun. 2, 1975, Pat. No. 4,003,162.

[51] Int. Cl.[2] ..... E06B 1/70

[52] U.S. Cl. ..... 49/468

[58] Field of Search ..... 49/468, 469, 470, 482, 49/471, 467

[56] References Cited

U.S. PATENT DOCUMENTS

| | | | |
|---|---|---|---|
| 1,139,195 | 5/1915 | Krause | 49/468 |
| 1,178,859 | 4/1916 | Krause | 49/468 |
| 2,839,796 | 6/1958 | Quoss | 49/469 X |
| 2,862,261 | 12/1958 | Quoss | 49/469 X |
| 3,254,453 | 6/1966 | Dennis | 49/482 |
| 3,967,412 | 7/1976 | Governale | 49/468 |

*Primary Examiner*—Philip C. Kannan

[57] ABSTRACT

The present invention relates to an adjustable threshold for use in door openings and adjustable to provide a better seal between the threshold and the door comprising first and second partial thresholds, fastening means to secure said first partial threshold to the floor, a flexible partial threshold operably mounted to and disposed between said first and second partial threshold, and a plurality of adjustable fastening means operably mounted on and disposed between said first and second partial thresholds such that such adjustable fastening means cause the first and second partial thresholds to be drawn toward or away from each other and thereby cause the flexible threshold to raise or lower at various points along the length of the threshold.

1 Claim, 2 Drawing Figures

ADJUSTABLE THRESHOLDS AND METHODS OF MAKING AND USING THE SAME

BACKGROUND OF THE INVENTION

This application is a continuation-in-part of application Ser. No. 582,979 filed June 2, 1975 now U.S. Pat. No. 4,003,162.

Conventional threshold devices are needed to install on the floor of door openings to provide a transition between floor surfaces and a sealing match between the lower edge of the door and the lower portion of the door opening.

Devices which are available are usually limited in that they require removal to alter and thus require additional time and expense and also additional skill. Another limitation is that the devices now available are generally restricted to a linear adjustment along the length of the threshold.

SUMMARY OF THE INVENTION

It is therefore an object of the present invention to provide an adjustable door threshold the altitude of which is independently adjustable at different points along the length thereof.

It is a further object of the present invention to provide such a device, the altitude of which may be adjusted while installed without necessitating the removal of the device.

A further object of the present invention is to provide such a device which will provide an air tight seal between the door and threshold.

A further object of the present invention is to provide such a device which may be installed and its purposes achieved by persons with less training than that required to install threshold presently available.

A further object of the present invention is to provide such a device which is simply and economically manufactured, assembled and used.

These together with other objects and advantages which will become subsequently apparent, reside in the details and construction and operation as more fully hereinafter described and claimed, reference being had to the accompanying drawings forming a part hereof, whrein like numerals refer to like parts throughout, and in which;

DETAILED DESCRIPTION OF THE INVENTION

Figure 1:
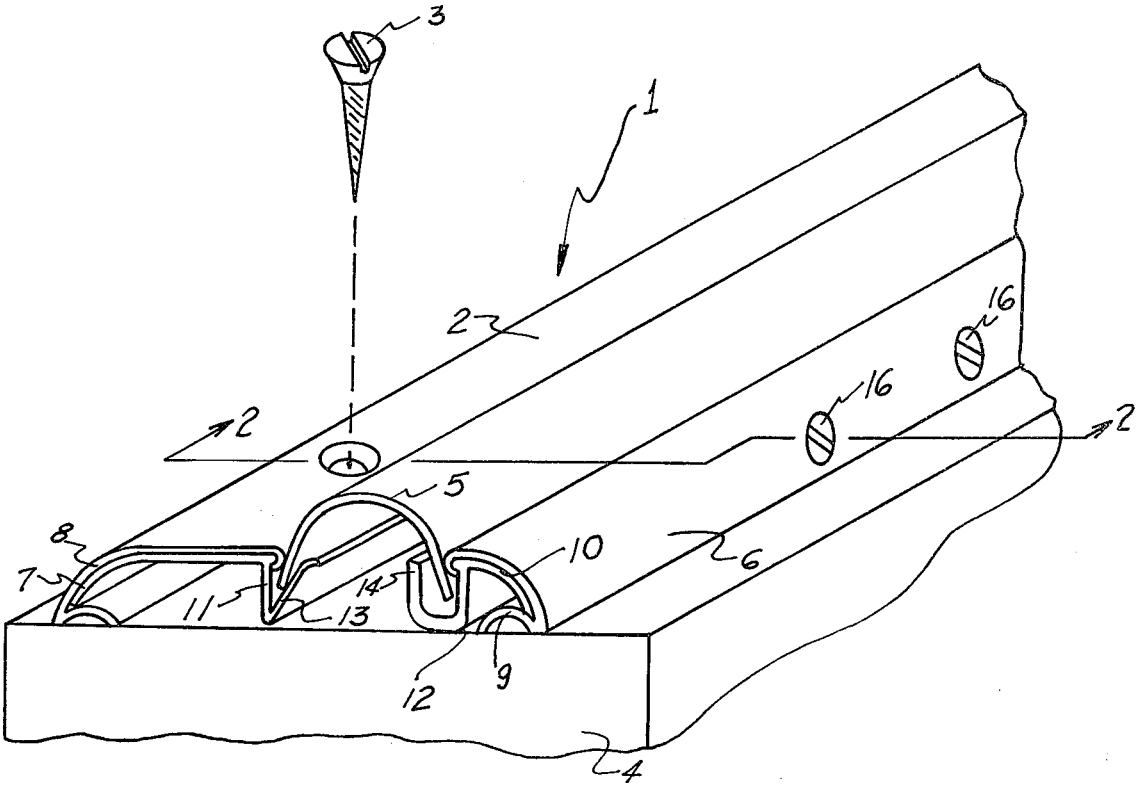
FIG. 1 is a perspective view of an adjustable threshold device constructed in accordance with and embodying the present invention.

Referring now in more detail and by reference characters to the drawings which illustrate a practical embodiment of the present invention, FIG. 1, is a perspective view of threshold, 1, constructed in accordance with and embodying the present invention. As shown in FIG. 1, device, 1, comprises first partial section, 2, which is provided with a plurality of fasteners, 3, to secure same to the floor, 4, with flexible section, 5, mounted in section, 2, and partial section, 6, and disposed therebetween. Partial sections, 2, and, 6, are shown to each comprise separate portions, 7, and, 8, and, 9, and, 10, respectively. It is clear that these sections, 2, and, 6, may be integrally constructed. Wood screws not shown, are typicaly used to secure section, 6, to floor, 4.

Recess portions, 11, and, 12, of sections, 2, and, 6, respectively are shaped as shown to accept the end portions, 13, and, 14, of section, 5, in such a manner so as to facilitate the interlocking of section, 5, with sections, 2, and, 6, as section, 6, is moved towards or away from section, 2.

Figure 2:
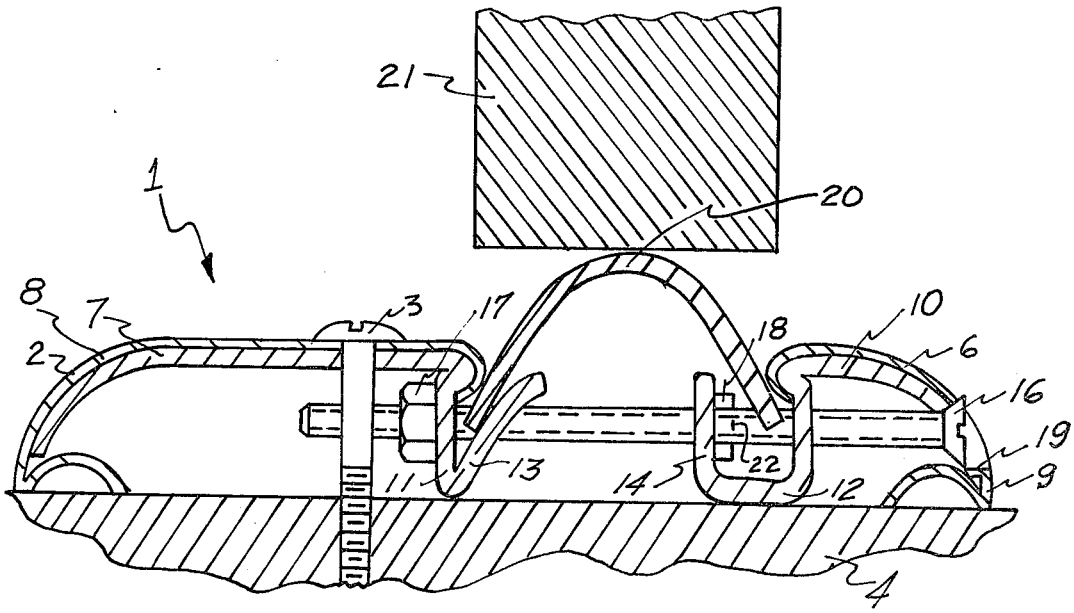
FIG. 2 is a sectional view of the device shown in FIG. 1.

As shown in FIG. 2, adjustment means, 15, comprises screw, 16, nut, 17, and c-ring, 18, and is mounted in recess, 19, in section, 6, and through conventional apertures in sections, 6, and, 2, not shown. Nut, 17, is affixed to portion, 11. Screw, 16, is provided with an annular groove, 22, in which c-ring, 18, is disposed. It is seen from FIGS. 1 and 2 that by rotating screw, 16, to advance same, section, 6, is caused to move towards section, 2, with member, 20, exerting an opposite spring force against section, 6. The spring force is restrained by c-ring, 18.

It is readily apparent that as sections, 6, and, 2, are brought together or separated then the uppermost portion, 20, of section, 5, is raised or lowered respectively and thus the uppermost portion is moved nearer or farther from the lower edge of door, 21.

It should be understood that changes and modifications in the form, construction, arrangement and combination of the adjustable threshold and methods of making and using the same may be made and substituted for those herein shown and described without departing from the nature and principle of my invention.

Having thus described my invention, what I claim is new and desire to secure by United States Letters Patent is:

1. An adjustable threshold for use in door openings comprising, first and second separate elongated partial threshhold sections, said sections provided with an elongated recess of "V" and of "U" shaped cross section respectively disposed such that each recess opens upwardly, fastening means to secure said first section to the floor of said door opening, elongated flexible and resilient center section means operably mounted in said recesses in said first and second sections and disposed therebetween, adjusting means operably coupled to said first and second sections and disposed therebetween comprising, bolt means extending through said first and second section means, nut means attached to said first section and near the threaded end of said bolt and C-ring means removably attached to and disposed about said bolt means and disposed within the "U" shaped recess in the section nearest the head end of said bolt means.

* * * * *